United States Patent [19]

Gopel et al.

[11] 4,369,961

[45] Jan. 25, 1983

[54] APPARATUS FOR WITHDRAWING FLAT CARTON BLANKS FROM A STACK THEREOF

[75] Inventors: Helmut Gopel, Dusseldorf; Hartmut Klapp, Kaarst, both of Fed. Rep. of Germany

[73] Assignee: Jagenberg Werke AG, Dusseldorf, Fed. Rep. of Germany

[21] Appl. No.: 205,046

[22] Filed: Nov. 7, 1980

[30] Foreign Application Priority Data

Nov. 16, 1979 [DE] Fed. Rep. of Germany ..... 2946426

[51] Int. Cl.[3] ..... B65H 3/04

[52] U.S. Cl. ..... 271/10; 271/35; 271/118; 271/165

[58] Field of Search ..... 271/34, 35, 118, 165, 271/166, 10

[56] References Cited

U.S. PATENT DOCUMENTS

| | | | |
|---|---|---|---|
| 3,406,963 | 10/1968 | Goss | 271/35 |
| 3,934,869 | 1/1976 | Strobel | 271/35 |
| 3,944,210 | 3/1976 | McInerny | 271/35 |
| 3,990,694 | 11/1976 | Mason | 271/118 X |

FOREIGN PATENT DOCUMENTS

| | | | |
|---|---|---|---|
| 2725947 | 6/1977 | Fed. Rep. of Germany | 271/35 |

*Primary Examiner*—Richard A. Schacher

*Attorney, Agent, or Firm*—Sprung, Horn, Kramer & Woods

[57] ABSTRACT

An apparatus for the withdrawal of flat carton blanks made of paperboard, boxboard or corrugated board from a stack located in back of a retaining mechanism, which comprises conveyor belts and belt guides disposed beneath the stack of blanks for the controlled withdrawal of the lowermost blank and, directly adjacent to such takeoff conveyor and driven in synchronism therewith, a conveyor for the onward transportation of the individually withdrawn blanks. The belts of the takeoff conveyor under the stack are carried downwardly at an acute angle relative to the belt guides starting in the vicinity of retaining mechanism and there is disposed below said conveyor belts, in the vicinity of said retaining mechanism an eccentrically mounted roll whose eccentric shaft is driven by a drive controlled in synchronism with the drive of the takeoff conveyor.

12 Claims, 9 Drawing Figures

APPARATUS FOR WITHDRAWING FLAT CARTON BLANKS FROM A STACK THEREOF

BACKGROUND OF THE INVENTION

The present invention relates to an apparatus for the withdrawal of flat carton blanks made of paperboard, boxboard or corrugated board from a stack located in back of a retaining means, which comprises conveyor belts and belt guides disposed beneath the stack of blanks for the controlled withdrawal of the lowermost blank and, directly adjacent to such takeoff conveyor and driven in synchronism therewith, a conveyor for the onward transportation of the individually withdrawn blanks.

An apparatus of this type is known from German Pat. No. 1,139,513, for example. That apparatus comprises a retaining means having a slot for the withdrawal of the lowermost blank, said slot being opened and closed by means of a stop adapted to be moved upwardly and downwardly. In operation, the takeoff conveyor is in constant contact with the lowermost sheet.

Due to the relative speed between the takeoff-conveyor belts and the blanks, and possibly between the blank being moved on the takeoff conveyor and the conveyor for the onward transportation of the withdrawn blanks, there is necessarily relative motion between the belts and the blanks. In the case of many lacquered or powdered blanks, such relative motion results even after short production runs in fouled, slippery takeoff-conveyor belts causing production stoppages and breakdowns due to irregularly spaced blanks. Moreover, the relative motion between blank and conveyor belts gives rise to rather pronounced belt wear.

SUMMARY OF THE INVENTION

It is the object of the invention to provide an apparatus of the type described above which overcomes these drawbacks of prior-art apparatuses, is of simple construction, and permits the satisfactory withdrawal of individual blanks from the stack without skewing, with the individual withdrawn blanks uniformly spaced apart, and with the takeoff-conveyor belts making minimal contact with the blanks.

In accordance with the invention, this object is accomplished in that the belts of the takeoff conveyor under the stack of blanks are carried downwardly at an acute angle relative to the belt guides, starting in the vicinity of the retaining means, and that there is disposed below the conveyor belts, in the vicinity of the retaining means, an eccentrically mounted roll whose eccentric shaft is driven by a drive controlled in synchronism with the drive of the takeoff conveyor. With such an arrangement, the takeoff-conveyor belts are cyclically raised in the vicinity of the retaining means, and the contact force between conveyor belts and blank, and hence the withdrawal power, increases with increasing speed. When the lowermost blank in the stack has been withdrawn, the takeoff-conveyor belts make contact with the next blank only at the instant when that blank, too, is to be withdrawn.

The eccentric shaft is advantageously driven from the drive for the takeoff conveyor. Alternatively it may be driven by a motor with a disk-type rotor which is controlled photoelectrically.

To permit adaptation to blanks of different lengths and adjustment of the spacing between the individual withdrawn blanks, the eccentric shaft is best driven by a drive with variable transmission ratio or rotative speed.

Moreover, the belts of the takeoff conveyor may extend beyond the retaining means by about the length of the blanks.

Furthermore, the takeoff conveyor and the conveyor for the onward transportation of the individual blanks may advantageously be combined into a single conveyor.

The retaining means advantageously consists of at least two vertically adjustable positioning members. This will be of advantage especially when the blanks have irregularly shaped contours, as is often the case in the manufacture of folding cartons. The positioning members are then advantageously disposed perpendicularly to the direction of travel in alignment with each other, provided that the front edge of the blanks permits it.

The belt guides under the stack of blanks are advantageously formed by slide rails which are disposed on either side of the conveyor belts and which prevent contact between the blanks and the conveyor belts in the area where the latter are carried downwardly at an acute angle.

Finally, rolls are provided which are mounted on levers which point approximately in the direction of travel of the takeoff conveyor belts the rolls are downwardly resilient normal to the direction of travel. The rolls are advantageously provided forward of the retaining means in the direction of belt travel. This provision helps to satisfactorily maintain the orientation of the blanks on the belts of the takeoff conveyor as the blanks are being withdrawn and as they are transferred to the conveyor for onward transportation.

BRIEF DESCRIPTION OF THE DRAWINGS

An embodiment of the invention will now be described in greater detail with reference to the accompanying drawing, wherein.

DETAIL DESCRIPTION OF THE INVENTION

Figure 1:
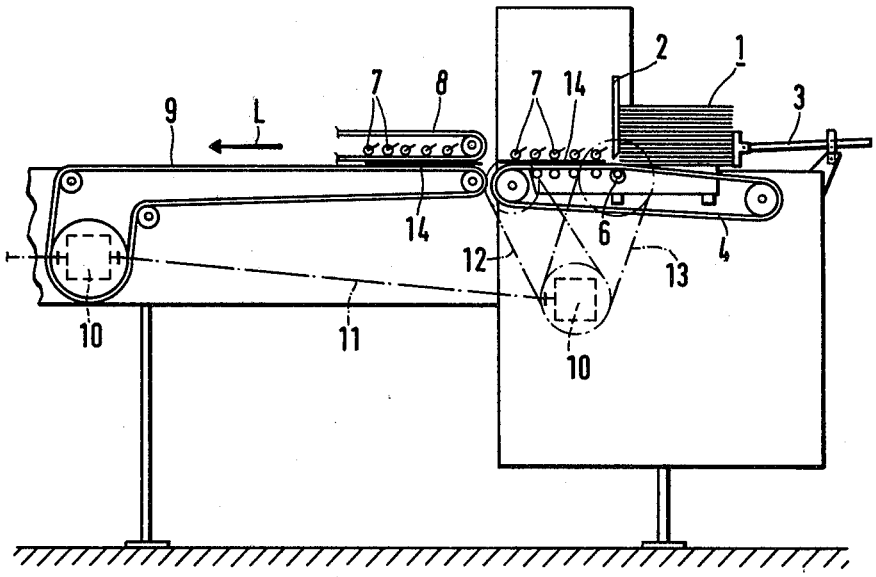
FIG. 1 is a diagrammatic side elevation of an apparatus for the withdrawal of individual blanks from a stack.

In the withdrawal apparatus shown in the drawing, which finds use especially in the withdrawal of individual blanks from the feeders of folding-carton gluing machines, a stack 1 of flat blanks is disposed in back of two positioning members 2 which hold the stack 1 in place and also align the blanks. The positioning members 2 are vertically adjustable. The lower part of the stack 1 is held at its rear end by a blank support 3 which is adjustable to the length of the blanks.

Disposed under the stack 1 of blanks is a takeoff conveyor comprising two conveyor belts 4 and fixed belt guides 5 located on either side of the conveyor belts 4. The latter extend beyond the positioning members 2, in the direction of belt travel, by about the length of the largest blank to be handled. A blank 14 which has already been withdrawn is clearly visible in this portion of the conveyor belts 4.

Figure 7:
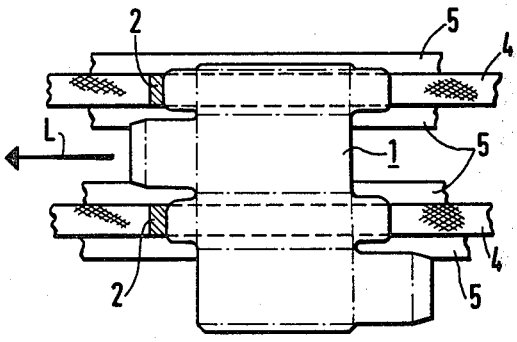
FIG. 7 is a top plan view of a typical blank held in position by two positioning members over the conveyor belts and belt guides.

The belt guides 5 extend in one plane throughout the length of the takeoff conveyor, and forward of the positioning members 2 the conveyor belts 4 extend parallel to the belt guides 5. Starting in the area under the positioning members 2, the conveyor belts 4 are guided downwardly at an acute angle relative to the belt guides 5, and the lowermost blank in the stack 1 therefore rests largely on the belt guides 5. Approximately beneath the positioning members 2 there is disposed below the conveyor belts 4 an eccentrically mounted roll 6 whose function will be described further on. FIGS. 3 to 6 show details of the position of the eccentrically mounted roll 6 while FIG. 7 is a top plan view of a typical blank resting on the conveyor belts 4 or the belt guides 5, respectively.

Adjacent to the takeoff conveyor there is a conveyor, driven in synchronism therewith, for the onward transportation of the individually withdrawn blanks 14 which comprises upper conveyor belts 8 and lower conveyor belts 9. Rolls 7 are mounted resiliently on levers which point approximately in the direction of travel of the conveyor belts 4 and 8, respectively, and the rolls 7 bear resiliently downwardly on the individual blanks on the takeoff conveyor and on the upper belts 8 of the conveyor normal to the direction of travel for the onward transportation of the withdrawn blanks 14.

The belts 4 of the takeoff conveyor and the lower belts of the conveyor for onward transportation of the individually withdrawn blanks 14 are driven in synchronism through a miter gear 10 with a Cardan shaft 11. Thus the individual blanks 14 are transferred from the belts 4 of the takeoff conveyor to the belts 9 of the conveyor for onward transportation without slippage, and hence without skewing, of the individual blanks 14.

The driving connection between the miter gear 10 and the belts 4 of the takeoff conveyor is preferably a narrowbelt drive 12.

The eccentric shaft of the eccentrically mounted roll 6 is driven by a drive 13 with a variable transmission ratio, preferably a Simplabelt drive. Through this drive 13, the eccentrically mounted roll 6 is cyclically and in synchronism with the drive of the conveyor belts 4 raised into its uppermost position (FIGS. 3 and 5) and lowered into its lowermost position (FIGS. 4 and 6), respectively. When it is in the lowered position, the lowermost blank in the stack 1 rests solely on the belt guides 5. The eccentrically mounted roll 6 is then raised and maintained in the position until the lowermost blank in the stack 1 is engaged by the conveyor belts 4 in the vicinity of the positioning members 2 and thus is withdrawn from under them. The roll 6 is then lowered from its uppermost position while the withdrawn blank 14 on the conveyor belts 4 moves on and is fed between the conveyor belts 8 and 9 without any speed differential relative to the latter. The direction of travel of the individually withdrawn blanks 14 is indicated in the drawing by an arrow L.

The spacings between the individual blanks 14 may be adjusted very precisely on the basis of the length and form of the blanks by varying the transmission ratio of the drive 13 for the eccentric shaft of the roll 6.

As a result of the cyclic raising of the conveyor belts 4 in the vicinity of the positioning members 2, the contact force between the conveyor belts 4 and the blank just withdrawn increases with increasing speed, and consequently the withdrawal force, too, increases. Over the stretch of takeoff conveyor which is forward of the positioning members 2, the individual blanks 14 are already being conveyed with the speed with which they are transferred to the conveyor for onward transportation, while prior to their withdrawal they rest largely on the belt guides 5 out of contact with the conveyor belts 4. This does away with the need for constant cleaning of the conveyor belts 4 with compressed air and cleaning rags, and the downtime of the apparatus as a whole is substantially reduced.

FIG. 7 shows a typical lowermost blank of a stack 1 abutting on the positioning members 2, which are preferably disposed perpendicularly to the direction of travel L in alignment with each other.

Figure 2:
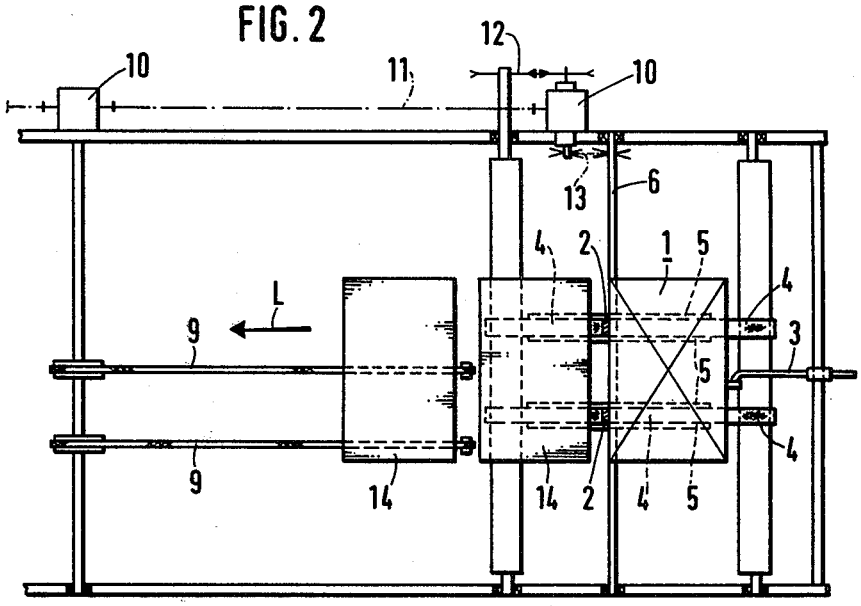
FIG. 2 is a top plan view of the apparatus of FIG. 1, with the upper conveyor belts and rolls omitted.
Figure 3:
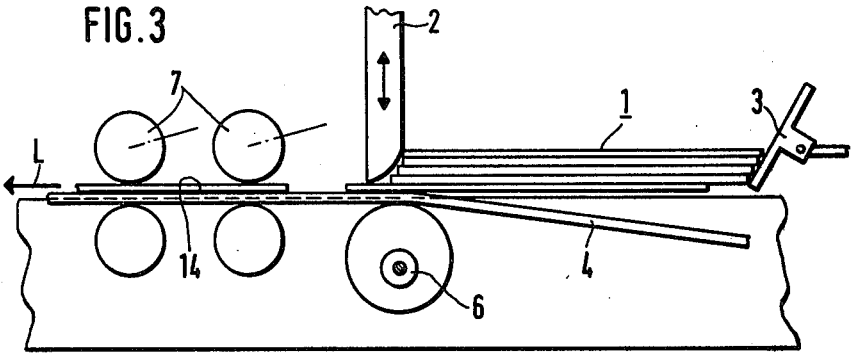
FIG. 3 is a section from FIG. 1 illustrating the withdrawal of the lowermost blank from a stack.
Figure 5:
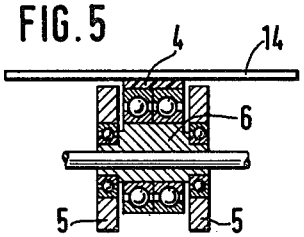
FIG. 5 is a cross section through the eccentrically mounted roll in the position according to FIG. 3.
Figure 6:
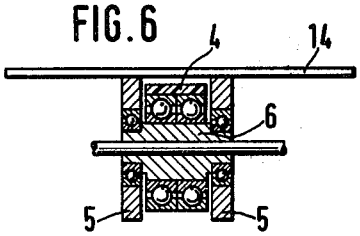
FIG. 6 is a cross section through the eccentrically mounted roll in the position according to FIG. 4.
Figure 4:
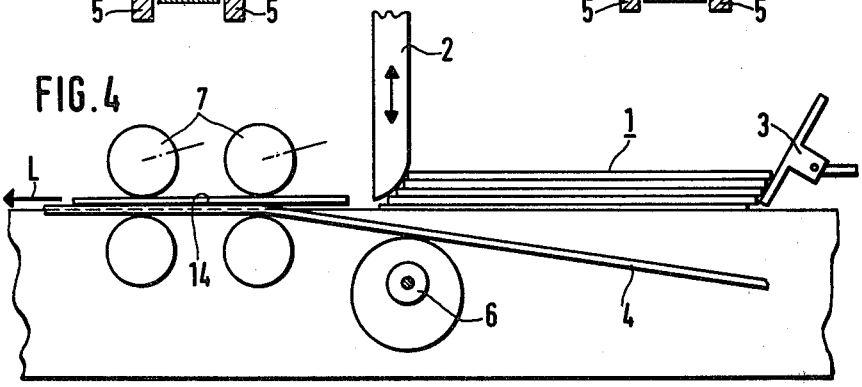
FIG. 4 is a section from FIG. 1, as shown in FIG. 3, except that the lowermost blank from the stack is not in contact with the conveyor belt.
Figure 8:
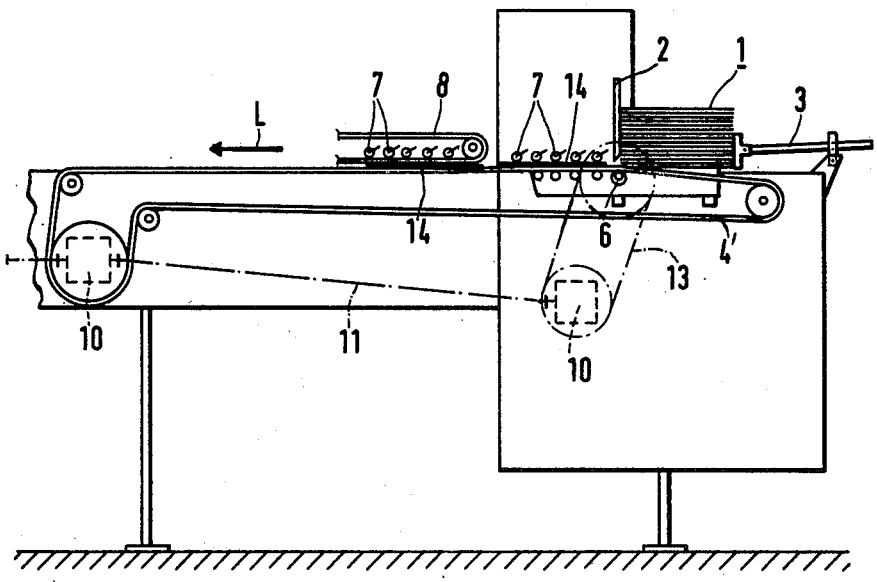
FIG. 8 is a diagrammatic side elevation of an alternative embodiment of the apparatus according to the present invention.
Figure 9:
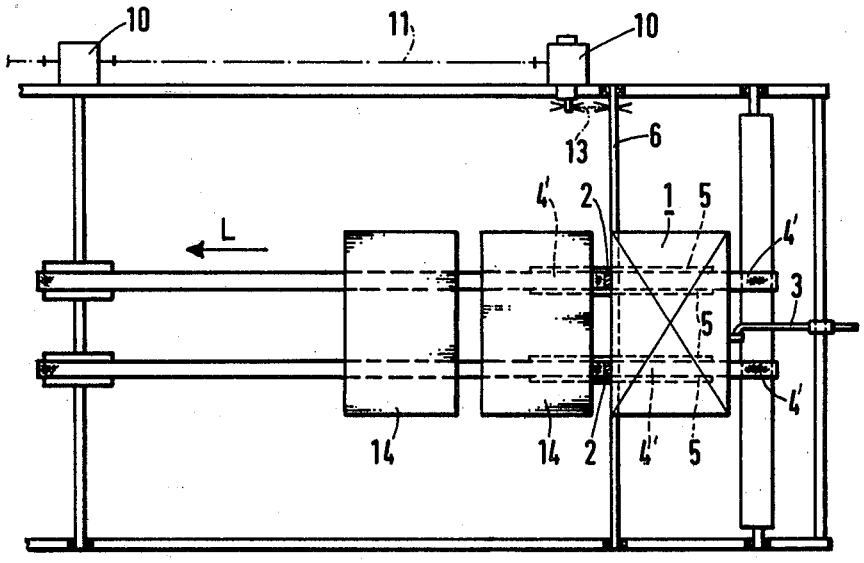
FIG. 9 is a top plan view of the apparatus of FIG. 8 with the upper conveyor and rolls omitted.

FIGS. 8 and 9 show the structure of FIGS. 1 and 2, with the modification that the takeoff conveyor and the conveyor for onward transportation of the individually withdrawn flat blanks comprise a single conveyor 4' rather than two conveyors 4 and 9, with the result that belt drive 12 is not needed.

It will be appreciated that the instant specification and claims are set forth by way of illustration and not of limitation, and that various changes and modifications may be made without departing from the spirit and scope of the present invention.

What is claimed is:

1. In an apparatus for the withdrawal of flat carton blanks made of paperboard, boxboard or corrugated board from a stack and having guide means on which the stack is disposed, retaining means immediately downstream of the stack, a takeoff conveyor with at least one conveyor belt disposed beneath the stack of blanks for the controlled withdrawal of the lowermost blank and a conveyor disposed directly downstream of the takeoff conveyor and driven in synchronism therewith for the onward transportation of the individually withdrawn blanks, the improvement wherein the guide means supports the lowermost blank in a given plane, the takeoff conveyor has means mounting a run of the at least one belt under the stack to dispose same downwardly at an acute angle relative to the given plane with the uppermost portion starting at the leading edge of the lowermost blank in the vicinity of the retaining means and means disposed below said at least one conveyor belt for periodically lifting a portion thereof disposed below said retaining means to effect engagement of the belt with only the lowermost blank and only upon the lifting of the belt.

2. The apparatus according to claim 1, wherein the lifting means comprises a shaft and a roll eccentrically mounted thereon disposed beneath the retaining means and driven in synchronism with the takeoff conveyor.

3. The apparatus according to claim 2, further comprising a conveyor gear for the shaft and the takeoff conveyor.

4. The apparatus according to claim 2, wherein the shaft is driven by a motor with a disk-type rotor.

5. The apparatus according to claim 2, 3 or 4, wherein the drive of the shaft has a variable transmission ratio or rotative speed.

6. The apparatus according to claim 1, wherein the at least one belt of the takeoff conveyor extends downstream of the retaining means by about the length of the flat blanks.

7. The apparatus according to claim 1, wherein the takeoff conveyor and the conveyor for the onward transportation of the individually withdrawn flat blanks comprise a single conveyor.

8. The apparatus according to claim 2, wherein the retaining means comprises at least two vertically adjustable positioning members disposed vertically above the shaft.

9. The apparatus according to claim 8, wherein the positioning members are disposed perpendicularly to the direction of belt travel in alignment with each other.

10. The apparatus according to claim 1, wherein the guide means comprises slide rails disposed on either side of the at least one conveyor belts.

11. The apparatus according to claim 1, further comprising rolls and levers mounting same for resilient action normal to the direction of travel of the conveyor belts, the rolls disposed above the takeoff conveyor downstream of the retaining means.

12. The apparatus according to claim 1, wherein the guide means comprises support rolls disposed on either side of the at least one conveyor belt.

* * * * *